US012114696B2

(12) United States Patent
Moloney

(10) Patent No.: US 12,114,696 B2
(45) Date of Patent: Oct. 15, 2024

(54) AEROSOL PROVISION SYSTEM

(71) Applicant: Nicoventures Holdings Limited, London (GB)

(72) Inventor: Patrick Moloney, London (GB)

(73) Assignee: Nicoventures Trading Limited, London (GB)

( * ) Notice: Subject to any disclaimer, the term of this patent is extended or adjusted under 35 U.S.C. 154(b) by 873 days.

(21) Appl. No.: 15/733,698

(22) PCT Filed: Mar. 27, 2019

(86) PCT No.: PCT/EP2019/057780
§ 371 (c)(1),
(2) Date: Sep. 29, 2020

(87) PCT Pub. No.: WO2019/185745
PCT Pub. Date: Oct. 3, 2019

(65) Prior Publication Data

US 2021/0022395 A1 Jan. 28, 2021

(30) Foreign Application Priority Data

Mar. 29, 2018 (GB) ..... 1805256

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/42* (2020.01); *A24F 40/51* (2020.01); *A24F 40/20* (2020.01)

(58) Field of Classification Search
CPC ..... A24F 40/40; A24F 40/42; A24F 40/51; A24F 40/20; A24F 40/10; A24F 40/46;
(Continued)

(56) References Cited

U.S. PATENT DOCUMENTS 5,181,626 A 1/1993 Daenen et al.
D828,912 S 9/2018 Powell et al.
(Continued)

FOREIGN PATENT DOCUMENTS

CN 204232280 U 4/2015
CN 106617324 A 5/2017
(Continued)

OTHER PUBLICATIONS

International Preliminary Report on Patentability for Application No. PCT/US2018/057344, dated May 7, 2020, 8 pages.
(Continued)

*Primary Examiner* — Edwin A. Leon
(74) *Attorney, Agent, or Firm* — Husch Blackwell LLP

(57) ABSTRACT

An aerosol provision system for generating aerosol from a removable consumable comprising an aerosol forming material. The system includes an aerosol provision device and a removable consumable. The aerosol provision device includes a power source; a receptacle; and a first component configured to operate in response to power received from the power source. The removable consumable is for engagement with the receptacle, and the removable consumable comprises a second component configured to interact with the first component. The removable consumable defines an outer profile having at least a first alignment feature and the receptacle defines an inner profile comprising at least a second alignment feature corresponding to the first alignment feature; wherein the first and second alignment features are configured to restrict the orientation of the removable consumable to a single orientation when engaged with the receptacle such that the second component is aligned with the first component of the device when the consumable is engaged with the receptacle.

22 Claims, 6 Drawing Sheets

(51) Int. Cl.
*A24F 40/42* (2020.01)
*A24F 40/51* (2020.01)

(58) Field of Classification Search
CPC . A24F 40/50; A24F 40/65; A24D 1/20; G06F 16/381
See application file for complete search history.

(56) References Cited

U.S. PATENT DOCUMENTS

| | | | | |
|---|---|---|---|---|
| D843,052 | S | 3/2019 | Powell et al. | |
| 10,772,355 | B2 * | 9/2020 | Zuber | A61M 11/042 |
| 2014/0060554 | A1 * | 3/2014 | Collett | A24F 40/46 392/386 |
| 2016/0270438 | A1 | 9/2016 | Jackson et al. | |
| 2016/0374399 | A1 | 12/2016 | Monsees et al. | |
| 2017/0181471 | A1 | 6/2017 | Phillips et al. | |
| 2021/0007413 | A1 | 1/2021 | Moloney et al. | |
| 2021/0030059 | A1 | 2/2021 | Moloney | |
| 2021/0161215 | A1 * | 6/2021 | Sur | H05B 1/0227 |
| 2021/0212370 | A1 | 7/2021 | Moloney et al. | |

FOREIGN PATENT DOCUMENTS

| | | | |
|---|---|---|---|
| CN | 106723381 | A | 5/2017 |
| CN | 206482013 | U | 9/2017 |
| EP | 2779851 | A2 | 9/2014 |
| GB | 2534213 | A | 7/2016 |
| KR | 20150022127 | A | 3/2015 |
| KR | 20160116991 | A | 10/2016 |
| WO | WO-2013102611 | A2 | 7/2013 |
| WO | WO-2014020953 | A1 | 2/2014 |
| WO | 2016005530 | A1 | 1/2016 |
| WO | 2016005601 | A1 | 1/2016 |
| WO | 2016184824 | A1 | 11/2016 |
| WO | 2016187695 | A1 | 12/2016 |
| WO | WO-2016207407 | A1 | 12/2016 |
| WO | 2017178930 | A1 | 10/2017 |
| WO | WO-2017194763 | A2 | 11/2017 |
| WO | 2018019543 | A1 | 2/2018 |

OTHER PUBLICATIONS

International Search Report for Application No. PCT/US2018/057344, dated Feb. 19, 2019, 3 pages.
Office Action for Korean Application No. 10-2020-7013728, dated May 17, 2022, 15 pages.
Search Report dated Apr. 24, 2018 for Great Britain Application No. GB1717476.4, 6 pages.
"International Preliminary Report on Patentability received for PCT Patent Application No. PCT/EP2019/057780, dated Oct. 8, 2020", 9 pages.
"International Search Report and Written Opinion received for PCT Patent Application No. PCT/EP2019/057780, dated Jun. 14, 2019", 12 pages.

* cited by examiner

AEROSOL PROVISION SYSTEM

PRIORITY CLAIM

The present application is a National Phase entry of PCT Application No. PCT/EP2019/057780, filed Mar. 27, 2019, which claims priority from Patent Application No. 1805256.3, filed Mar. 29, 2018, each of which is hereby fully incorporated herein by reference.

TECHNICAL FIELD

The present disclosure relates to an aerosol provision system and to a removable consumable for use with an aerosol provision device.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first example, there is provided an aerosol provision system for generating aerosol from a removable consumable comprising an aerosol forming material. The system comprises an aerosol provision device and a removable consumable. The aerosol provision device comprises: a power source; a receptacle; and a first component configured to operate in response to power received from the power source. The removable consumable is for engagement with the receptacle, and the removable consumable comprises a second component configured to interact with the first component. The removable consumable defines an outer profile having at least a first alignment feature and the receptacle defines an inner profile comprising at least a second alignment feature corresponding to the first alignment feature; wherein the first and second alignment features are configured to restrict the orientation of the removable consumable to a single orientation when engaged with the receptacle such that the second component is aligned with the first component of the device when the consumable is engaged with the receptacle.

According to a second example, there is provided a removable consumable comprising aerosol generating material and configured to be used with an aerosol provision device to aerosolize aerosol generating material. The aerosol provision device comprises a first component configured to operate in response to power received from a power source. The removable consumable is configured to engage with a receptacle of the aerosol provision device and comprises a second component configured to interact with the first component. The removable consumable defines an outer profile having a first alignment feature configured to cooperate with a second alignment feature of the receptacle corresponding to the first alignment feature; and the first alignment feature is configured to restrict the orientation of the removable consumable to a single orientation when engaged with the receptacle such that, in use, the second component of the removable consumable is aligned with and interacts with the first component of the device.

According to a third example, there is provided an aerosol provision device for generating aerosol from a removable consumable comprising an aerosol forming material. The device comprises: a power source; a receptacle configured to engage the removable consumable; and a first component configured to operate in response to power received from the power source. The first component is configured to interact with a second component of the removable consumable. The receptacle defines an inner profile having at least a first alignment feature and the removable consumable defines an outer profile comprising at least a second alignment feature corresponding to the first alignment feature. The first and second alignment features are configured to restrict the orientation of the removable consumable to a single orientation when engaged with the receptacle such that the second component is aligned with the first component of the device when the consumable is engaged with the receptacle.

BRIEF DESCRIPTION OF THE DRAWINGS

Embodiments of the disclosure will now be described, by way of example only, with reference to the accompanying drawings, in which.

DETAILED DESCRIPTION

Figure 1:
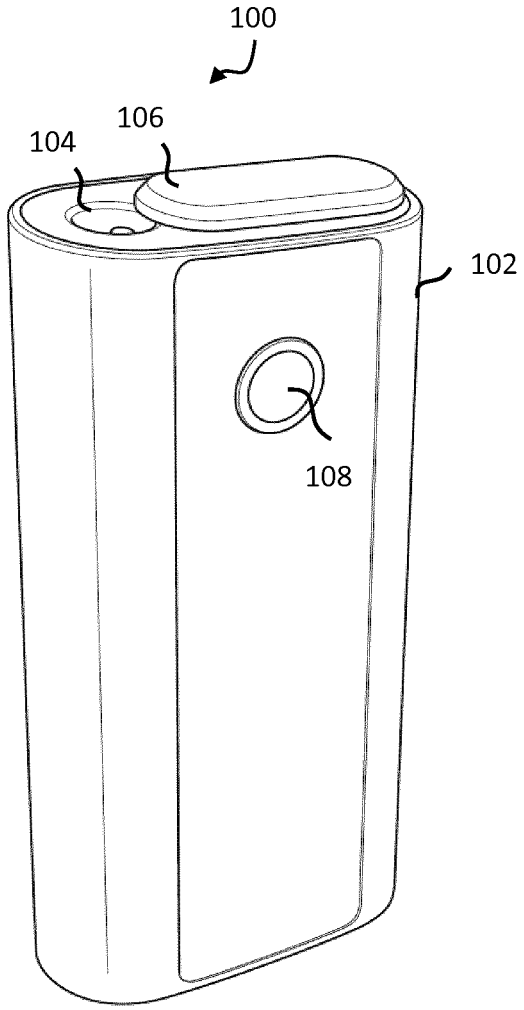
FIG. 1 shows a perspective view of an example of an aerosol provision device.
Figure 2:
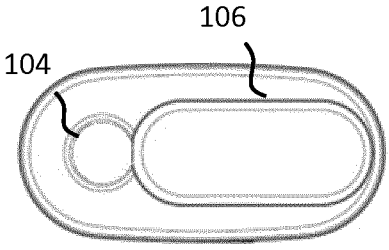
FIG. 2 shows a top view of the example aerosol provision device of FIG. 1.

Referring to FIG. 1, there is shown an example of an aerosol provision device 100. In broad outline, the device 100 may be used to heat a replaceable consumable, to generate an aerosol or other inhalable medium which is inhaled by a user of the device 100. FIG. 1 shows the device 100 without a replaceable consumable. FIG. 2 shows a top view of the device 100.

In FIGS. 1 and 2, the device 100 of this example comprises a housing 102. The housing 102 has an opening 104 in one end, which is configured to receive a replaceable consumable comprising an aerosol forming material. The aerosol forming material may be for example tobacco or other non-tobacco products, which may or may not contain nicotine and/or flavorants. As used herein, the terms "flavor" and "flavorant" refer to materials which, where local regulations permit, may be used to create a desired taste or aroma in a product for adult consumers. In some embodiments the aerosol forming material may comprise a vapor or aerosol generating agent or a humectant, such as glycerol, propylene glycol, triacetin or diethylene glycol. The replaceable consumable may be fully or partially inserted into the opening 104 so that it is received within a receptacle or chamber of the housing 102. In use, an aerosol generating element is arranged to aerosolize the aerosol generating material to form an aerosol for user inhalation. In this example, the aerosol generating element is a heater arranged in use to heat the replaceable consumable, although it should be appreciated that other aerosol generating elements adapted to generate aerosol may equally be used in other examples. The assembly may also comprise a lid, or cap 106, to cover the opening 104 when no consumable is in place. In FIGS. 1 and 2, the cap 106 is shown in an open configuration, however the cap 106 may slide into a closed configuration when the consumable is removed.

The device 100 may further comprise a control element 108. The control element 108 in this example is a button or a switch, and when a user activates the control element 108, the device 100 is switched on.

Figure 3:
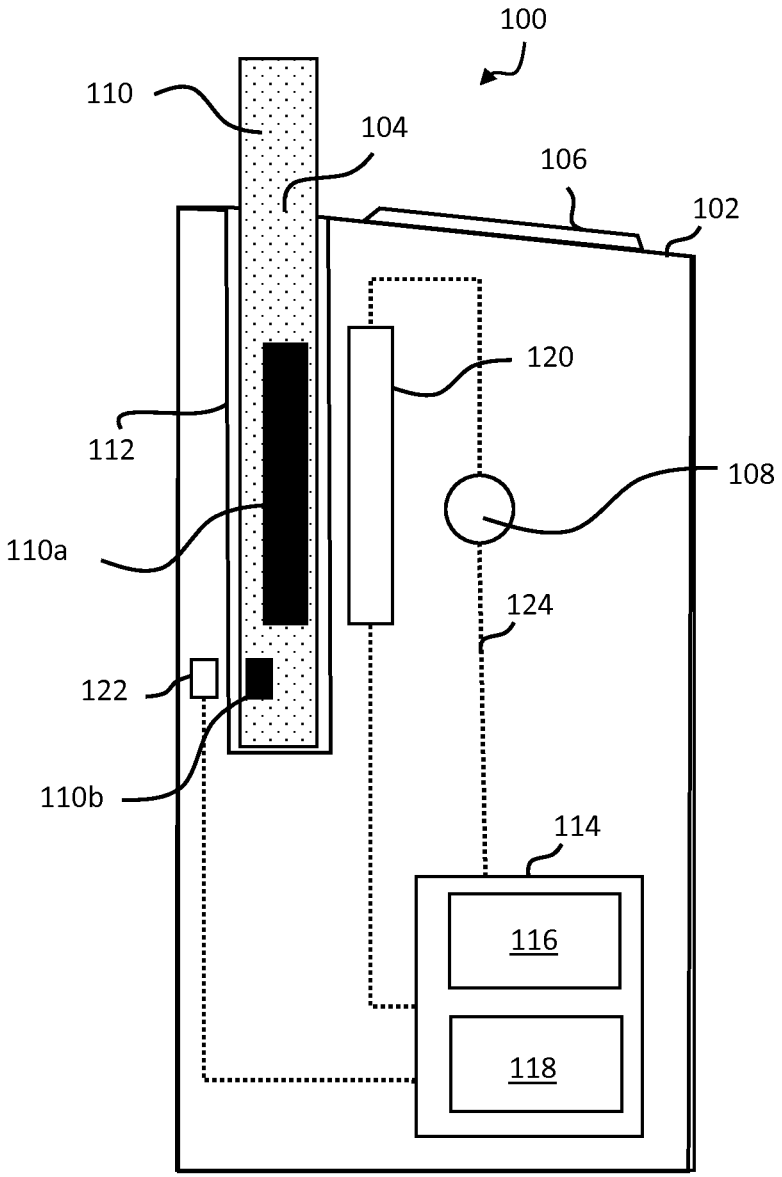
FIG. 3 shows a cross-sectional view of the example aerosol provision device of FIG. 1.

FIG. 3 shows a cross-sectional view of an example system 200 comprising the device 100, shown in FIG. 1, and a replaceable consumable 110. In this example, the replaceable consumable 110 has been inserted into the opening 104 of the device 100. The device 100 has a receptacle, or heating chamber 112 which, in use, contains the consumable 110 to be heated. Upon insertion, the consumable 110 is engaged with the receptacle. The device 100 comprises one or more heaters 120 arranged to heat the replaceable consumable 110 once the replaceable consumable 110 has been received within the receptacle 112. The consumable 110 therefore comprises a component, such as an aerosol forming material 110*a*, that interacts with the heater 120 to generate an aerosol upon heating. The replaceable consumable 110 may also comprise one or more other elements, such as packaging materials and/or one or more filters. In some example systems 100, the consumable comprises another component, such as a marker 110*b*, that is configured to be detected by a component of the device 100, which is discussed in more detail below.

The consumable 110 in this example is elongate, although the consumable may take any suitable shape. An end of the removable consumable 110 projects out of the device 100 through the opening 104 of the housing 102 such that user may inhale the aerosol through the consumable in use. In other examples the consumable 110 is fully received within the heating chamber 112 such that it does not project out of the device 100. In such a case, the user may inhale the aerosol directly from the opening 104, or via a mouthpiece which may be connected to the housing 102 around the opening 104.

The device 100 further has an electronics/power chamber 114 which in this example contains electrical control circuitry 116 and a power source 118. The electrical control circuitry 116 may include a controller, such as a microprocessor arrangement, configured and arranged to control the heating of the removable consumable. In some examples the control circuitry is also configured to receive a signal from a sensor 122 to identify the removable consumable 110, as discussed further below. The electrical control circuitry 116 may also receive a signal from the control element 108 and activate a heater 120 in response. As an alternative, the device 100 may comprise features that send a signal to the control circuitry 116 to cause the heater 120 to be automatically activated when a user is drawing on the device 100. Electronic elements within the device 100 are electrically connected via one or more wires 124, shown depicted as dashed lines.

The power source 118 stores energy for supply as power. It may be a battery, such as a rechargeable battery or a non-rechargeable battery. Examples of suitable batteries include for example a lithium-ion battery, a nickel battery (such as a nickel-cadmium battery), an alkaline battery and/or the like. The battery 118 is electrically coupled to one or more heaters 120 to supply electrical power when required to heat the replaceable consumable 110, and thereby generate an aerosol. The heater 120, is therefore a component that is configured to operate in response to power received from the power source 118. Similarly, the sensor 122 may also be a component that is configured to operate in response to power received from the power source 118.

The heater 120 may be an electrically resistive heater, including for example a nichrome resistive heater, a ceramic heater, etc. The heater 120 may be an induction heater (which includes the arrangements of a susceptor in, or forming, the chamber 112, or a susceptor in the consumable 110). Other heating arrangements may be used.

It is sometimes desirable for the device 100 to be able to restrict the orientation of the removable consumable 110 to a single orientation when engaged with the receptacle 112. This may ensure that the aerosol forming material is correctly aligned with the heater 120. In an example, some or all of the aerosol forming material 110*a* may not be uniformly distributed or arranged within the removable consumable 110, and in the example of FIG. 3, the aerosol forming material 110*a* is arranged closer to one side of the removable consumable 110. Furthermore, in some examples the heater 120 may not uniformly heat all regions within the receptacle 112. For instance, in the example of FIG. 3, the heater 120 is provided adjacent a part of the receptacle 112. Thus, it may be desirable control how the removable consumable 110 is orientated to ensure that the aerosol forming material 110*a* is arranged for optimal or at least improved heating of the aerosol forming material. For instance, an improved heat exchange between aerosol forming material and the heater 120 is provided when the two are aligned, which can reduce the total power required to generate aerosol from the aerosol forming material.

Alternatively or additionally, it may also be desirable for the device 100 to be able to identify or recognize the particular removable consumable 110 that has been introduced into the device 100 by a user. For example, in practice, the device 100 as a whole, including in particular the heating arrangement and the heating control provided by the electrical control circuitry 116, will often be optimized for a particular type of removable consumable 110 (e.g. one or more of size, shape, particular aerosol forming material, etc.). It would therefore be undesirable for the device 100 to be used with a removable consumable 110 having (significantly) different characteristics. Thus, if the device 100 can identify or recognize the particular removable consumable 110, or at least the general type of removable consumable 110, that has been introduced into the device 100, this can help eliminate or at least reduce counterfeit or other non-genuine removable consumables 110 being used with the device 100.

The device 100 may therefore comprise a component, such as a sensor 122 to detect a corresponding component, such as a marker 110*b* on, or in the removable consumable 110. Hence, the marker 110*b* is configured to interact with the sensor 122. The sensor 122 is coupled to the control circuitry 116 and power source 118, and thus operates in response to power received from the power source 118. Upon detection, a signal may be sent from the sensor 122 to the control circuitry 116, and the type of consumable may be determined. In some examples, the control circuitry 116 may only operate the heater 120 in cases where the consumable 110 is recognized, and will not operate the heater 120 when it does not recognize the consumable 110. In other examples however, it operates regardless of the consumable. In some examples data relating to the consumable (such as a type or type of aerosol forming material) is stored within memory of the device once the marker has been detected. The marker may be a barcode in some examples, and coded data may be retrieved from the marker. An indication of this data may also be stored within memory.

The device 100 may be arranged so that it provides some indication to the user that the removable consumable 110 has not been recognized. Alternatively or additionally, the device 100 may be arranged so that for example it follows a first heating pattern when it recognizes a first type of removable consumable 110 and follows a second, different heating pattern when it recognizes a second type of removable consumable 110 (and optionally may provide yet further heating patterns for other types of removable consumable 110). The heating patterns may differ in a number of ways, for example the rate of delivery of heat to the aerosol forming material 110*a*, the timing of various heating cycles, which part(s) of the aerosol forming material 110*a* are heated first, etc. This enables the same device 100 to be used with different types of removable consumable 110 with minimal interaction required of the user. If the device 100 is not able to identify the consumable 110, or the consumable 110 is not positively identified, then the device 100 may be configured not to heat the consumable 110.

In some examples the sensor 122 may be arranged at a specific location within the device 100. For example, the sensor 122 may be arranged within the receptacle 122 and may have a limited detection range. Similarly, the marker 110*b* may be arranged at a specific location on, or within the removable consumable 110, and may occupy a certain area or volume of the consumable 110. To ensure that the marker 110*b* is detected when a user inserts the consumable 110 into the receptacle, it is desirable for the device 100 to be able to restrict the orientation of the removable consumable 110 to a single orientation when engaged with the receptacle 112. This may ensure that the marker 110*b* is correctly aligned with the sensor 122, so that it can be detected. Restricting the orientation of the consumable so that the marker and sensor are aligned can mean that only one sensor 122 is needed, rather than having a plurality of sensors arranged within the device 100, which can reduce manufacturing costs of the device 100, as well as weight and electrical power requirements. Additionally, or alternatively, it may allow a smaller marker to be provided on or in the consumable.

Accordingly, for at least these reasons, it may be desirable to control the orientation of the consumable 110 to ensure that components of the device 100 are aligned with, and can interact with, components of the removable consumable 110. To achieve this, an aerosol provision system is provided wherein the removable consumable defines an outer profile having an alignment feature (or alignment features) and the receptacle defines an inner profile comprising a corresponding alignment feature (or alignment features). Thus, when the outer profile of the consumable is received within the inner profile of the receptacle, the alignment features restrict the orientation of the removable consumable to a single orientation when the removable consumable is engaged with the receptacle to ensure that one or more components of the consumable are aligned with one or more corresponding components of device. Various example alignment features will be described in relation to FIGS. 4-9.

Figure 4:
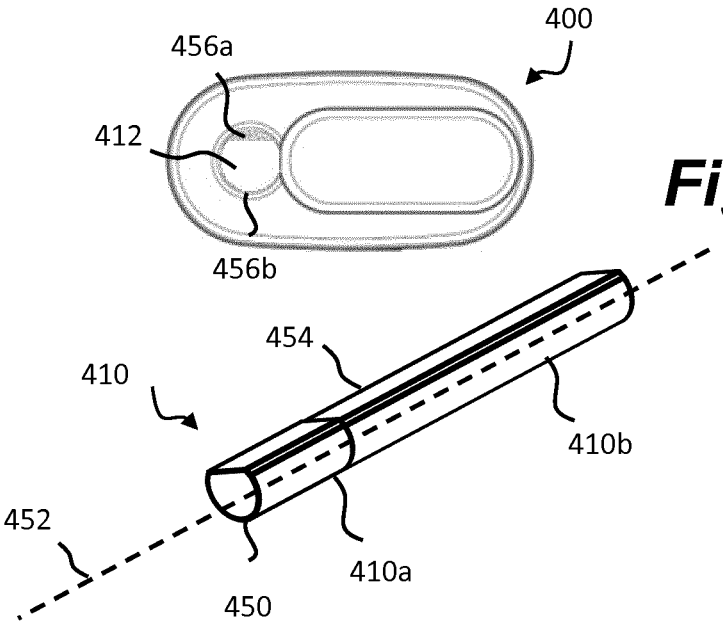
FIG. 4 shows a top view of a second example aerosol provision device and a second example removable consumable.

FIG. 4 depicts a top down view of an example aerosol provision device 400, and a perspective view of an example removable consumable 410. The aerosol provision device 400 comprises a component configured to operate in response to power received from a power source, such as a heater or sensor, as described in relation to FIG. 3. The component is configured to interact with a component of the consumable. For example, the heater may be configured to interact with aerosol forming material or the sensor may be configured to interact with a marker located on or in the consumable 410.

The consumable in this example comprises a proximal end 410*a* and a distal end 410*b*. The proximal end 410*a* may be directly received within the mouth of a user in use, or may be situated closest to the mouth of a user in use. The distal end 410*b* is therefore inserted into the receptacle of the device before the proximal end. The proximal end 410*a* may comprise one or more features that provide a visual indication that the end is the proximal end 410*a*, such as a different colored or patterned surface. In some examples the proximal end 410*a* comprises a filter.

To limit the orientation of the consumable within the receptacle of the device 400, the consumable has an end surface 450 that has no rotational symmetry (sometimes referred to as rotational symmetry of the first order) about a longitudinal axis 452 defined by the consumable 410. This is achieved by providing the consumable 450 with an alignment feature on its outer profile or surface that engages with the inner profile or surface of the receptacle within the device 400. In FIG. 4, the alignment feature is provided by a flat surface 454 formed along the length of the consumable 410. The end surface 450 therefore has a cross-sectional area that resembles a circle having had a segment removed.

The receptacle 412 of the device 400 is provided with a similarly shaped inner profile having a corresponding alignment feature. For example, in FIG. 4, the receptacle comprises an inner profile having straight, flat section 456*a*, and a rounded section 456*b*. The flat section 456*a* is configured to receive and engage the corresponding flat surface 454 of the consumable 410. The flat section 456*a* of the receptacle 412 and the flat surface 454 of the consumable 410 may therefore be said to be alignment features that restrict orientation of the removable consumable. A user is unable to orientate the consumable differently because of the alignment features. Components of the consumable can therefore be aligned with components of the device when the consumable is engaged with the receptacle.

To further limit the orientation of the consumable in the receptacle 412, the consumable 410 is configured to ensure that the proximal end 410*a* cannot be inserted in the receptacle 412 before the distal end 410*b*, the proximal end 410*a* may have a different shape/dimension to the remaining part of the consumable (i.e., the distal end 410*b* and middle part of the consumable). For example, in FIG. 4, the proximal end 410*a* has a slightly greater diameter than the distal end 410*b* and middle part of the consumable 110, and is also greater than the internal diameter of the receptacle 412. Accordingly, when the consumable is inserted into the receptacle 412 distal end 410*b* first, the proximal end 410*a* protrudes above the housing of device 400 (in a similar manner to that as shown in FIG. 3). In alternative implementations, the proximal end 410*a* may be completely cylindrical (i.e., alignment feature 454 does not extend along the proximal part of consumable 410).

In one example the consumable is an elongate rod. Such a consumable may be provided by forming tobacco in the shape of the outer profile depicted in FIG. 4, for example. Thus, in one example, aerosol forming material is formed to define the outer profile, or at least a portion of the outer profile of the consumable. Such a construction provides a simple and effective means for producing a consumable of any desired shape. For example, tobacco may be easily formed, compressed, cut or molded into a variety of shapes. In some examples a thin layer of additional material, such as paper, is also wrapped around the aerosol forming material. By having the aerosol forming material on or close to the outer surface, the aerosol forming material can be more efficiently heated by a heater within the device. Similarly, a marker can be added to the outer surface of the consumable, or be embedded within the aerosol forming material or filter.

In certain examples, the aerosol forming material also defines the alignment feature. Hence, if a portion of the aerosol forming material is shaped to restrict the orientation, the alignment feature may be provided by the aerosol forming material itself, rather than being provided by non-aerosol forming materials. This construction can provide a relatively inexpensive method of producing alignment features. In addition, as mentioned above, certain aerosol forming materials, such as tobacco, can be easily formed into different shapes. In some examples a thin layer of additional material, such as paper, is also wrapped around the aerosol forming material. In other examples however, other non-aerosol forming components of the removable consumable define the alignment feature.

Figure 5:
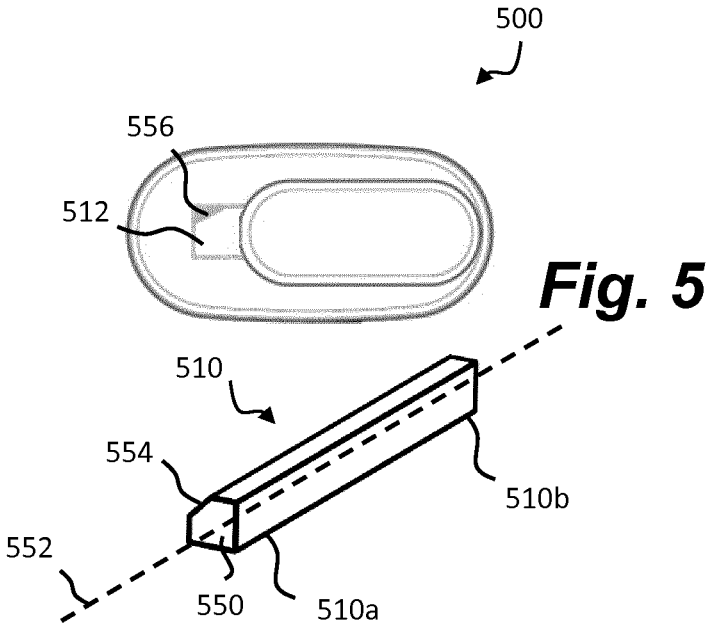
FIG. 5 shows a top view of a third example aerosol provision device and a third example removable consumable.

FIG. 5 depicts another example top down view of an aerosol provision device 500 and an example removable consumable 510. The consumable 510 is substantially similar to that described in FIG. 4, however rather than the shape of the consumable being generally cylindrical, the consumable has a greater number of exterior faces. The exterior faces may define a generally prismatic shape.

The consumable 510 in this example comprises a proximal end 510*a* and a distal end 510*b*. The proximal end 510*a* may comprise one or more features (not shown) that provide a visual indication that the end is the proximal end 510*a*.

To limit the orientation of the consumable within the receptacle of the device 500, the consumable has an end surface 550 that has no rotational symmetry about a longitudinal axis 552 defined by the consumable 510. In addition, in this example, the outer profile of the consumable 510 has an asymmetric exterior cross-sectional shape, which thereby defines an alignment feature. The consumable therefore is not symmetrical about a line perpendicular to an axis extending through the geometric centroid of the cross section, unlike the example of FIG. 4. The outer profile of the consumable 510 is configured to engage with an inner profile of a receptacle 512 of the device 500, and so the inner profile of the receptacle 512 also comprises an asymmetric interior cross-sectional shape. In FIG. 5, the alignment feature of the consumable 510 is provided by a flat surface 554 formed along the length of the consumable 510. The end surface 550 therefore has a cross-sectional area that resembles a square having had a portion removed, a corner cut off in this example. As shown in FIG. 5, a triangular region has been "cut off" from the consumable. One side "cut off" side of the triangle is shorter in length than the other "cut off" side; resulting in the asymmetric exterior cross-sectional shape. In some examples, the triangle defined by the cut-off portion may be a scalene triangle, a triangle in which all three sides are different lengths.

The receptacle 512 of the device 500 is provided with a similarly shaped inner profile having a corresponding alignment feature. For example, in FIG. 5, the receptacle comprises an inner profile defining an inner area that also resembles a square having had a portion removed. A surface 556 of the inner profile is configured to receive and engage the corresponding flat surface 554 of the consumable 510. The surface 556 of the receptacle 512 and the surface 554 of the consumable 510 may therefore be said to be alignment features that restrict orientation of the removable consumable. Components of the consumable can therefore be aligned with components of the device when the consumable is engaged with the receptacle. In one example the consumable is elongate, and has an outer profile that generally corresponds to a cuboid having had a portion of the consumable removed. Such a consumable may be provided by forming and/or joining non-aerosol forming substrate materials, such as plastic, foil, cardboard and the like, in the shape of the outer profile depicted in FIG. 5, for example. The consumable may also comprise an air inlet and an air outlet to provide an airflow path through the consumable 510. An aerosol forming material, such as tobacco, or a gel may be located within the consumable, along the airflow path. For example, a gel comprising nicotine may be deposited on an inner surface of the substrate. Thus, in one example non-aerosol forming components of the removable consumable define the alignment feature.

Figure 6:
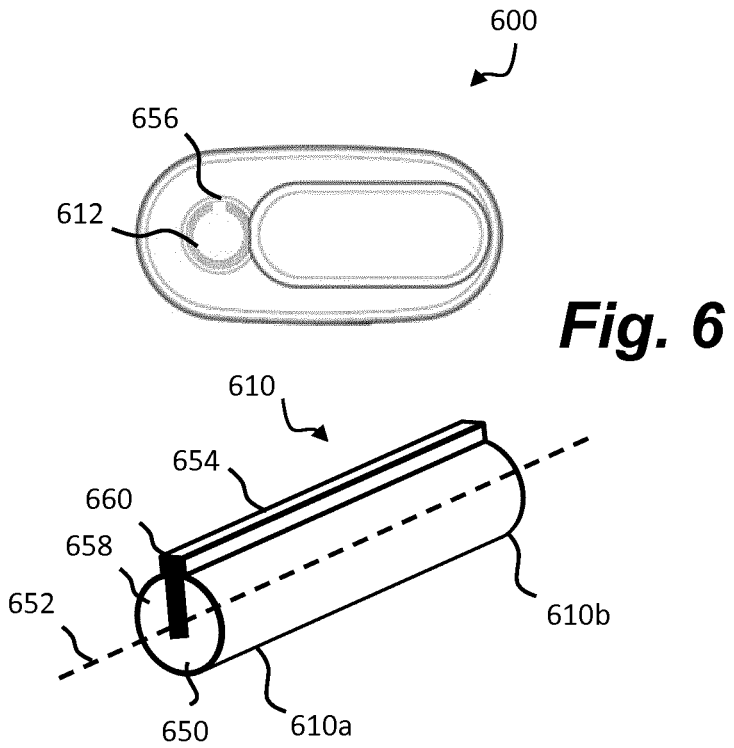
FIG. 6 shows a top view of a fourth example aerosol provision device and a fourth example removable consumable.

FIG. 6 depicts another example top down view of an aerosol provision device 600 and an example removable consumable 610. The consumable 610 is substantially similar to that described in FIG. 4, however the alignment feature is provided by a protrusion formed on an outer surface of the consumable 610.

The consumable 610 in this example is generally cylindrical and comprises a proximal end 610*a* and a distal end 610*b*. The proximal end 610*a* may comprise one or more features (not shown) that provide a visual indication that the end is the proximal end 610*a*.

To limit the orientation of the consumable within the receptacle 612 of the device 600, the consumable has an end surface 650 that no rotational symmetry about a longitudinal axis 652 defined by a cylindrical portion of the consumable 610. The consumable 610 comprises a protrusion 654 or ridge formed along the length of the consumable 610, the protrusion being parallel to the longitudinal axis 652, which thereby defines an alignment feature. The outer profile of the consumable 610 is configured to engage with an inner profile of a receptacle 612 of the device 600. In some examples the protrusion is not formed along the entire length of the consumable, for example extending along only part of the length of the consumable.

The receptacle 612 of the device 600 is provided with a similarly shaped inner profile having a corresponding alignment feature. For example, in FIG. 6, the receptacle comprises an inner profile having a recess 656 that is dimensioned to receive the protrusion 654 of the consumable 610. The recess 656 of the receptacle 612 and the protrusion 654 of the consumable 610 may therefore be said to be alignment features having a "lock and key" type configuration, that restrict the orientation of the removable consumable. Components of the consumable can therefore be aligned with components of the device when the consumable is engaged with the receptacle.

In some examples, a portion 660 of the outer profile of the consumable 610 is provided by a non-aerosol forming substrate material, such as plastic, and a portion 658 of the outer profile of the consumable is provided by aerosol forming materials, such as tobacco. In this example, the portion 660 forming the alignment feature 654 is a substrate material, and the portion 658 not forming the alignment feature is aerosol forming material. Generally, a substrate material is more rigid than aerosol forming material, so such a construction may provide a more robust alignment feature. However in other examples the portion 660 forming the alignment feature 654 may be aerosol forming material, and the portion 658 may be substrate material.

Figure 7:
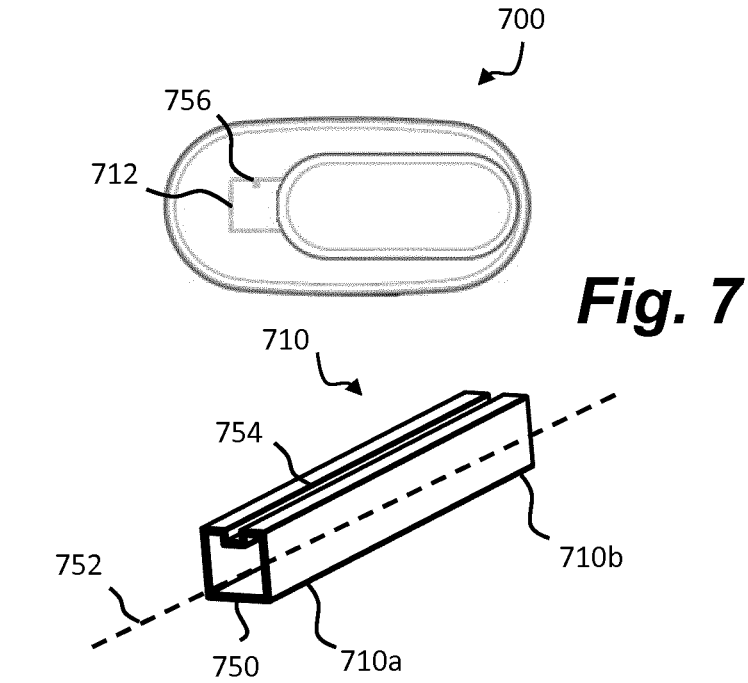
FIG. 7 shows a top view of a fifth example aerosol provision device and a fifth example removable consumable.

FIG. 7 depicts another example top down view of an aerosol provision device 700 and an example removable consumable 710. The consumable 710 is substantially similar to that described in FIG. 6, however the alignment feature is provided by a recess 754 formed on an outer surface of the consumable 710.

The consumable 710 in this example comprises a proximal end 710*a* and a distal end 710*b*. The proximal end 710*a* may comprise one or more features (not shown) that provide a visual indication that the end is the proximal end 710*a*.

To limit the orientation of the consumable within the receptacle 712 of the device 700, the consumable has an end surface 750 that has no rotational symmetry about a longitudinal axis 752 defined by the consumable 710. The consumable 710 comprises a recess 754 formed along the length of the consumable 710, between two parallel ridges, where the recess 754 and ridges are arranged parallel to the longitudinal axis 752. The recess therefore defines an alignment feature. The outer profile of the consumable 710 is configured to engage with an inner profile of a receptacle 712 of the device 700.

The receptacle 712 of the device 700 is provided with a similarly shaped inner profile having a corresponding alignment feature. For example, in FIG. 7, the receptacle comprises an inner profile having a protrusion 756 that is dimensioned to be received within the recess 754 of the consumable 710. The protrusion 756 of the receptacle 712 and the recess 754 of the consumable 710 may therefore be said to be alignment features having a "lock and key" type configuration, that restrict the orientation of the removable consumable. Components of the consumable can therefore be aligned with components of the device when the consumable is engaged with the receptacle.

In some examples, the recess 754 is offset from a midpoint of an edge of the end surface 750. Similarly, the protrusion 756 may also be offset from a midpoint of an inner surface wall of the receptacle 712. This means that the outer profile of the removable consumable defines an asymmetric shape and the inner profile of the receptacle defines an asymmetric shape.

Figure 8:
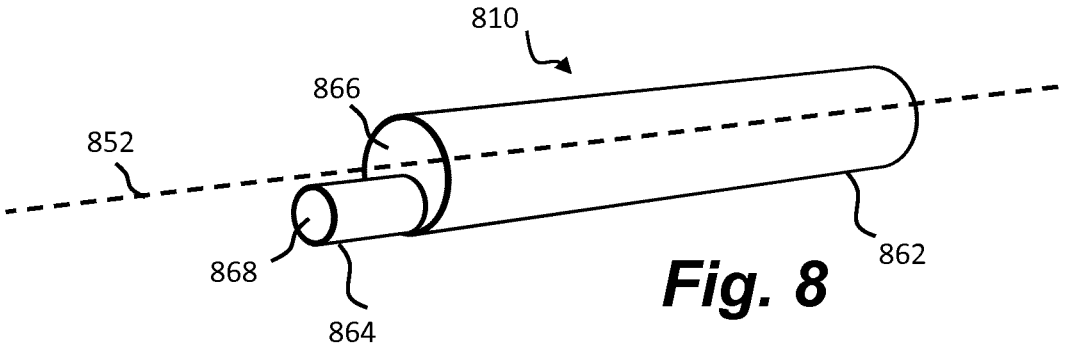
FIG. 8 shows a sixth example removable consumable.

FIG. 8 depicts another example removable consumable 810. The consumable 810 in this example comprises a first portion 862 and a second portion 864. In this example both portions 862, 864 are cylindrical, however one, or both portions may be provided with any shape. The first portion 862 forms the proximal end, and the second portion 864 forms the distal end. The consumable 810 defines a longitudinal axis 852, and the first and second portions 862, 864 are arranged along the direction of the axis 852.

The first portion 862 has a first end surface 866 having a first perimeter. The first perimeter encloses a first area of the first end surface 866. Similarly, the second portion 864 has a second end surface 868 having a second perimeter edge different to the first perimeter, which encloses a second area of the second end surface 868, the second area being smaller than the first area. The first end surface 866, the first perimeter, the second end surface 868 and the second perimeter are arranged perpendicular to the longitudinal axis 852. In this example the first portion 862 and the second portion 864 are integrally formed, however in other examples they may be formed separately and then joined together. The first portion therefore has a first cross section perpendicular to the longitudinal axis, and the second portion has a second cross section perpendicular to the longitudinal axis. Thus, the first cross section and second cross section together define an alignment feature.

In the example of FIG. 8, to limit the orientation of the consumable within a receptacle of the device, the second portion 864 is offset, or displaced, from the central axis of the first portion 862 (i.e. a longitudinal axis defined by the first portion). Hence, as a whole, the consumable has no rotational symmetry about a longitudinal axis 852. The radially offset second portion 868 may therefore define the alignment feature. The consumable 810 therefore has an outer profile having an alignment feature. The outer profile of the consumable 810 is configured to engage with an inner profile of a receptacle 812 of a device 800, depicted in FIG. 9.

In some examples, the alignment feature can additionally or alternatively be defined by the first cross section of the first portion having a perimeter which is a different length to a perimeter of the second cross section of the second portion. For example, cross sections of the first and second portions may have different shapes and/or sizes. In some examples the alignment feature can additionally or alternatively be defined by the first cross section being oriented about the longitudinal axis differently than the second cross section. For example, cross sections of the first and second portions may have different or the same shape, but one portion may be rotated about the longitudinal axis to define the alignment feature. In some examples the alignment feature can additionally or alternatively be defined by the first cross section having an area which is different to an area of the second cross section.

Figure 9:
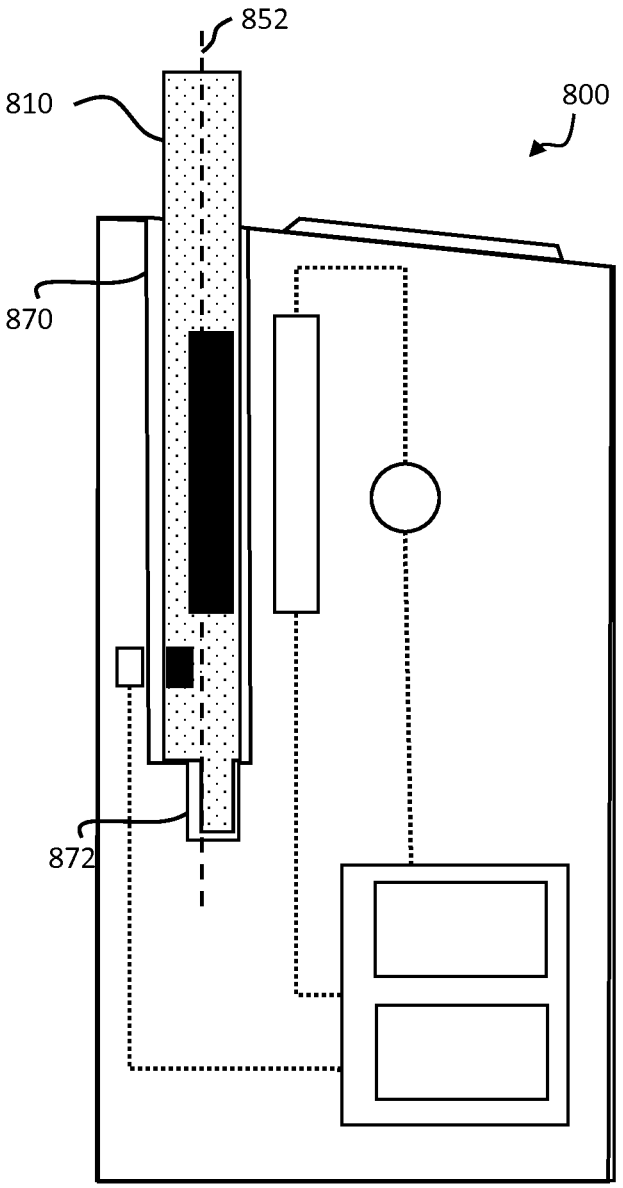
FIG. 9 shows a cross-sectional view of a sixth example aerosol provision device configured to receive the consumable of FIG. 8.

FIG. 9 shows a cross-sectional view of an example device 800 comprising a replaceable consumable 810. The receptacle 812 of the device 800 is provided with a similarly shaped inner profile having a corresponding alignment feature to restrict the orientation of the consumable 810. The receptacle 812 comprises a first chamber 870 configured to receive the first portion 862 and a second chamber 872 configured to receive the second portion 864. As with the consumable 810, the second chamber is displaced from a longitudinal axis defined by the first chamber. Thus, the consumable 810 can only be received within the device when the consumable 810 is orientated correctly. This ensures components of the consumable are aligned with components of the device.

In some examples, the second portion 864 does not comprise aerosol forming material.

In each of the examples described in FIGS. 4-9, the alignment features of the consumable are arranged at radial positions around an axis defined by the consumable, such as the longitudinal axis. Similarly, in the examples described in FIGS. 4-9, the receptacle defines an insertion axis along which the removable consumable may be inserted by a user. Thus, the corresponding alignment features of the receptacle are also arranged at radial positions around the insertion axis.

In each of the examples described in FIGS. 4-9, one or more particular visual indicia or markers 117 may be present on the consumable. For example, a line, shape, or logo may be located at a particular position on the outer surface of the consumable. In one example, the indicia may become obscured by the housing of the device if the consumable is properly inserted into the device. Thus, if this indicia remains visible after insertion, the consumable may not be fully and/or properly inserted. The indicia therefore provides a means for a user to determine whether the consumable is inserted correctly.

Figure 10:
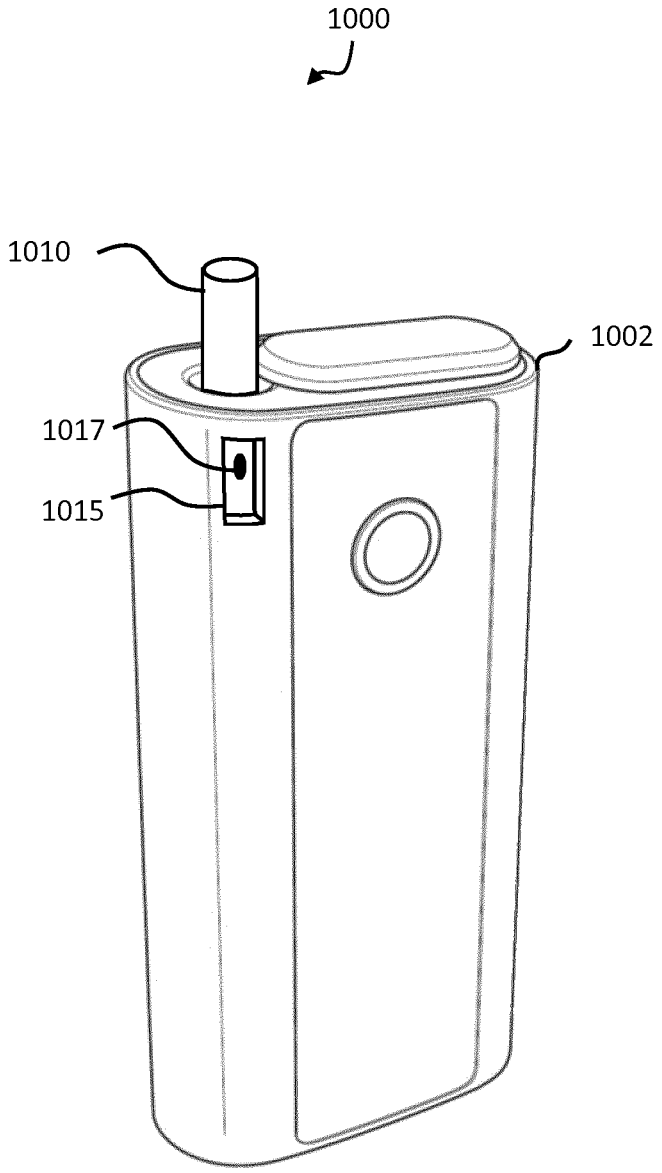
FIG. 10 shows a perspective view of another example of an aerosol provision device.

In another example, the housing of the device may comprise a window, gap or opening in its outer surface. FIG. 10 shows an example of such an aerosol provision device 1000. The device 1000 and consumable 1010 may additionally comprise any of the features described in relation to FIGS. 1-9. The window, gap or opening 1015 allows the visual indicia 1017 on the consumable 1010 to be seen by a user, so that the user can determine whether the consumable has been inserted correctly. For example, only when the consumable 1010 has been inserted and aligned correctly will the visual indicia 1017 be visible through the window 1015. If the consumable has not been inserted correctly, the indicator 1017 may be vertically or rotationally offset from the window 1015 and therefore not visible, or only partially visible. This may prompt a user to realign the consumable to ensure that the consumable is aligned correctly. In one particular example, the window, gap or opening may be a cut-out in the upper part of the housing 1002. For example, rather than being a through hole defined by the housing 1002 as shown in FIG. 10, a U-shaped cut-out may extend from the top edge of the housing.

In order to address various issues and advance the art, the entirety of this disclosure shows by way of illustration and example various embodiments in which the claimed invention may be practiced and which provide for a superior apparatus and system. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An aerosol provision system for generating aerosol from a removable consumable comprising an aerosol forming material, comprising:

an aerosol provision device comprising:

a power source, a receptacle, a sensor; and an aerosol generating element;

wherein the sensor and the aerosol generating element are configured to operate in response to power received from the power source; and a removable consumable for engagement with the receptacle, the removable consumable comprising:

aerosol forming material; and a marker;

wherein the aerosol generating element is configured to aerosolize the aerosol forming material and the sensor is configured to detect the marker when the removable consumable is engaged with the receptacle;

wherein the removable consumable defines an outer profile having at least a first alignment feature and the receptacle defines an inner profile comprising at least a second alignment feature corresponding to the first alignment feature; and wherein the first alignment feature and the second alignment feature are configured to restrict an orientation of the removable consumable to a single orientation when engaged with the receptacle such that the aerosol forming material is aligned with the aerosol generating element and the marker is aligned with the sensor.

2. The aerosol provision system according to claim 1, wherein the aerosol generating element includes a heater.

3. The aerosol provision system according to claim 1, wherein the aerosol forming material defines at least part of the outer profile of the removable consumable.

4. The aerosol provision system according to claim 1, wherein the aerosol forming material defines at least part of the first alignment feature.

5. The aerosol provision system according to claim 1, wherein the receptacle defines an insertion axis and the first alignment feature and the second alignment feature are arranged radially around the insertion axis.

6. The aerosol provision system according to claim 1, wherein the removable consumable defines a longitudinal axis and comprises a first portion and a second portion in a direction of the longitudinal axis, the first portion has a first cross-section perpendicular to the longitudinal axis, the second portion has a second cross-section perpendicular to the longitudinal axis, wherein the first cross-section and the second cross-section together define the first alignment feature.

7. The aerosol provision system according to claim 6, wherein at least one of:

the first cross-section has a perimeter which is a different length than a perimeter of the second cross-section;

the first cross-section is oriented about the longitudinal axis differently than the second cross-section;

the first cross-section has an area which is different than an area of the second cross-section; or wherein the first cross-section is offset from the second cross-section, relative to the longitudinal axis.

8. The aerosol provision system according to claim 1, wherein the outer profile of the removable consumable defines a first asymmetric shape thereby defining the first alignment feature, and the inner profile of the receptacle defines a second asymmetric shape thereby defining the second alignment feature.

9. The aerosol provision system according to claim 1, wherein the aerosol forming material comprises tobacco.

10. The aerosol provision system according to claim 1, wherein the aerosol forming material comprises a gel.

11. A removable consumable comprising:

aerosol generating material and configured to be used with an aerosol provision device to aerosolize aerosol generating material, the aerosol provision device comprising a sensor and an aerosol generating element configured to operate in response to power received from a power source, wherein the removable consumable is configured to engage with a receptacle of the aerosol provision device, the removable consumable comprising:

aerosol forming material; and a marker, wherein the removable consumable defines an outer profile having a first alignment feature configured to cooperate with a second alignment feature of the receptacle corresponding to the first alignment feature; and wherein the first alignment feature is configured to restrict an orientation of the removable consumable to a single orientation when engaged with the receptacle such that, in use, the aerosol forming material is configured to be aerosolized by the aerosol generating element when the removable consumable is engaged with the receptacle and the aerosol forming material is aligned with the aerosol generating element, and the marker is configured to be detected by the sensor when the removable consumable is engaged with the receptacle and the marker is aligned with the sensor.

12. The removable consumable according to claim 11, wherein the aerosol generating element is a heater.

13. The removable consumable according to claim 11, wherein the aerosol forming material defines at least part of the outer profile of the removable consumable.

14. The removable consumable according to claim 11, wherein the aerosol forming material defines at least part of the first alignment feature.

15. The removable consumable according to claim 11, wherein the removable consumable defines an axis and the first alignment feature is arranged radially around the axis.

16. The removable consumable according to claim 11, wherein the removable consumable defines a longitudinal axis and comprises:

a first portion and a second portion in a direction of a longitudinal axis, the first portion having a first cross-section perpendicular to the longitudinal axis, the second portion having a second cross-section perpendicular to the longitudinal axis, wherein the first cross-section and second cross-section together define the first alignment feature.

17. The removable consumable according to claim 16, wherein at least one of:

the first cross-section has a perimeter which is a different length than a perimeter of the second cross-section;

the first cross-section is oriented about the longitudinal axis differently than the second cross-section;

the first cross-section has an area which is different than an area of the second cross-section; or wherein the first cross-section is offset from the second cross-section, relative to the longitudinal axis.

18. The removable consumable according to claim 11, wherein the outer profile of the removable consumable defines a first asymmetric shape thereby defining the first alignment feature.

19. The removable consumable according to claim 11, wherein the aerosol forming material comprises tobacco.

20. The removable consumable according to claim 11, wherein the aerosol forming material comprises a gel.

21. The removable consumable according to claim 11, wherein the consumable includes at least one visual indicia, the at least one visual indicia positioned on the removable consumable such that when the removable consumable is inserted into the receptacle, the at least one visual indicia is visible to a user or is obscured from a view of the user to signify that the removable consumable has been correctly inserted into the receptacle.

22. An aerosol provision device for generating aerosol from a removable consumable comprising an aerosol forming material and a marker, the aerosol provision device comprising:

a power source; a sensor; a receptacle configured to engage the removable consumable; and an aerosol generating element configured to operate in response to power received from the power source, wherein the aerosol generating element is configured to aerosolize the aerosol forming material when the removable consumable is engaged with the receptacle and wherein the sensor is configured to detect the marker when the removable consumable is engaged with the receptacle;

wherein the receptacle defines an inner profile having at least a first alignment feature and the removable consumable defines an outer profile comprising at least a second alignment feature corresponding to the first alignment feature; and wherein the first alignment feature and the second alignment feature are configured to restrict an orientation of the removable consumable to a single orientation when engaged with the receptacle such that aerosol forming material is aligned with the aerosol generating element and the marker is aligned with the sensor when the removable consumable is engaged with the receptacle.

* * * * *